US011075478B2

(12) United States Patent
Kuan

(10) Patent No.: US 11,075,478 B2
(45) Date of Patent: Jul. 27, 2021

(54) CONNECTOR FOR CONNECTING CABLE AND CIRCUIT BOARD

(71) Applicant: P-TWO INDUSTRIES INC., Taoyuan (TW)

(72) Inventor: Tung-Ching Kuan, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 16/905,944

(22) Filed: Jun. 19, 2020

(65) Prior Publication Data

US 2021/0005994 A1 Jan. 7, 2021

(30) Foreign Application Priority Data

Jul. 3, 2019 (TW) ..... 108123609

(51) Int. Cl.
*H01R 12/79* (2011.01)
*H01R 12/88* (2011.01)
*H01R 12/77* (2011.01)

(52) U.S. Cl.
CPC ..... *H01R 12/79* (2013.01); *H01R 12/771* (2013.01); *H01R 12/88* (2013.01)

(58) Field of Classification Search
None
See application file for complete search history.

(56) References Cited

U.S. PATENT DOCUMENTS

| | | | | |
|---|---|---|---|---|
| 10,305,209 | B2 * | 5/2019 | Ishishita | H01R 12/774 |
| 10,804,652 | B2 * | 10/2020 | Muro | H01R 13/405 |
| 10,992,072 | B2 * | 4/2021 | Shimada | H01R 12/775 |
| 2014/0051291 | A1 * | 2/2014 | Safir | H01R 12/88 439/607.35 |
| 2015/0171536 | A1 * | 6/2015 | Kameda | H01R 12/78 439/329 |
| 2020/0266564 | A1 * | 8/2020 | Shimada | H01R 12/775 |

* cited by examiner

*Primary Examiner* — Ross N Gushi

(57) ABSTRACT

A connector for connecting a cable and a circuit board is disclosed. The connector includes an upper cover plate, a lower plate body and an auxiliary member. Through the combination of the upper cover plate and the lower plate body, the cable can be held in an accommodation space therebetween. When an external force is applied to the upper cover plate, the upper cover plate will be unlocked to form an angle between the upper cover plate and the lower plate body, and then the holding member locking the cable is deformed to release the cable.

10 Claims, 4 Drawing Sheets

CONNECTOR FOR CONNECTING CABLE AND CIRCUIT BOARD

CROSS-REFERENCE TO RELATED APPLICATION

This application claims the benefit of Taiwan Patent Application No. 108123609, filed on Jul. 3, 2019, in the Taiwan Intellectual Property Office, the disclosure of which is entirely incorporated herein by reference.

BACKGROUND

1. Field

The invention relates to a connector, more particularly to a connector automatically latching cables.

2. Description of the Related Art

Traditionally, the cable is connected by using an automatic latch connector. In order to achieve the purpose of automatic latching, the structure of the automatic latch connector needs to provide a holding structure. The holding structure occupies a certain space, so that the height of the automatic latch connector is higher. Therefore, it is not convenient to use an automatic latch connector in some using environments.

Herein, a connector is provided for solving the problem caused by a conventional connector.

SUMMARY

A first aspect of the invention is to provide a connector comprising an upper cover plate, a lower plate body and an auxiliary member to achieve automatic latching.

A second aspect of the invention is based on the aforementioned connector, the upper cover plate is engaged with the lower plate body, and a force (that is, a pulling force) is applied to the rear end of the upper cover plate to release the latched cable.

A third aspect of the invention is to provide an opening in the upper cover plate according to the aforementioned connector, so that when the upper cover plate is combined with the lower plate body, a part of the holding member (a structure for latching the cable) is protruded from the opening without interference achieve a thinning aspect.

In order to achieve the above and other aspects, a connector for connecting a cable to a circuit board is provided. The connector comprises an upper cover plate, a lower plate body, and an auxiliary member.

The upper cover plate comprises an opening disposed on a surface of the upper cover plate, an extension arm formed on an edge of the upper cover plate, a fastening member disposed on an outer side of the extension arm, and a first connecting member disposed on one terminal of the extension arm.

The lower plate body connects to the upper cover plate. The lower plate body comprises a terminal slot for disposing terminals, an accommodation space for inserting the cable, a holding member disposed in the actuation slot and corresponding to the opening, and a second connecting member disposed on a side of the rotating base. The accommodation space comprises an actuation slot and a rotating base disposed on a side of the actuation slot for disposing the extension arm.

The auxiliary member is disposed on the lower plate body and coupled to the rotating base.

The upper cover plate is combined with the lower plate body by combining the first connecting member and the second connecting member. The fastening member acts on the rotating base and cooperates with the holding member for holding cable in the accommodation space. The cable is released by deforming the holding member when an external force is applied to the upper cover plate to form an angle between the upper cover plate and the lower plate body.

Compared with prior arts, the connector above is an auto-lock type. When a cable is inserted into the connector, the cable will be automatically locked. Through the fastening member of the upper cover plate and the auxiliary member, the automatic latch is more stable. Moreover, by pulling up the upper cover plate (that is, on the side where the cable is not inserted), the cable can be released from the connector.

DETAILED DESCRIPTION

In order to fully understand the aspects, characteristics and effects of the invention, the following specific embodiments and the accompanying drawings which will be described later are used to make a detailed description of the invention.

In the invention, "a" or "an" is used to describe the units, elements and components described herein. This is only for convenience of explanation and provides a general meaning to the scope of the invention. Therefore, unless it is obvious that it meant otherwise, such a description should be understood to include one, at least one, and the singular also includes the plural.

In the invention, the terms "comprising", "including", "having", "containing" or any other similar terms are intended to cover non-exclusive inclusions. For example, an element, structure, article, or device containing a plurality of elements is not limited to only those elements listed herein, but may include an element, structure, article, or device that is not explicitly listed but is other requirements which are generally inherent to the element, structure, article, or device. In addition, unless expressly stated to the contrary, the term "or" means an inclusive "or" rather than an exclusive "or".

Figure 1:
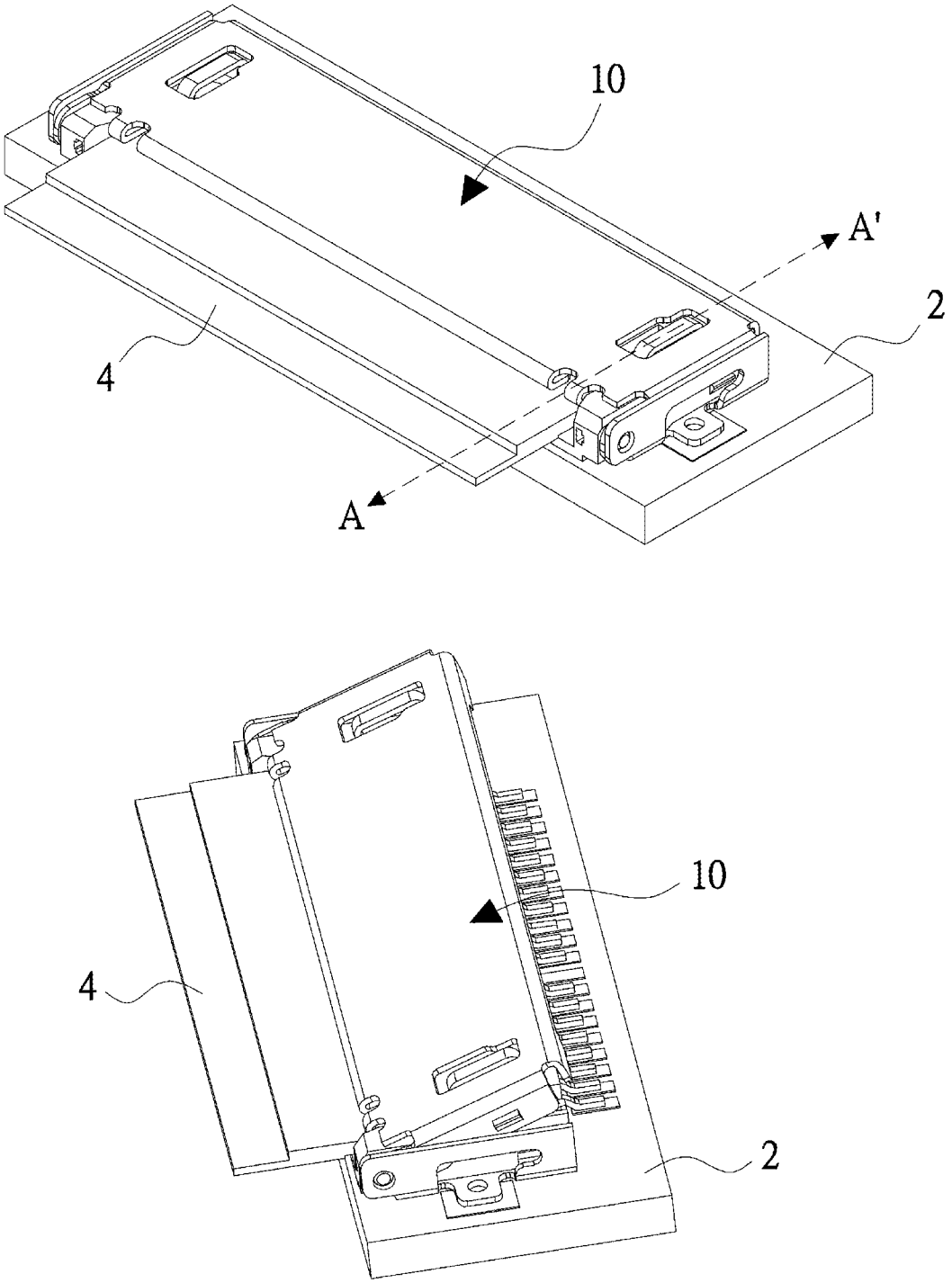
FIG. 1 is a structural schematic diagram of a connector according to a first embodiment of the invention.

Please refer to FIG. 1, which is a structural schematic diagram of a connector according to a first embodiment of the invention. In FIG. 1, a connector 10 can be used for connecting a cable 4 and a circuit board 2. The upper diagram of FIG. 1 is a state where the connector 10 latches the cable 4, and the lower diagram of FIG. 1 is a state where the connector 10 is released from the latched cable 4.

Figure 2:
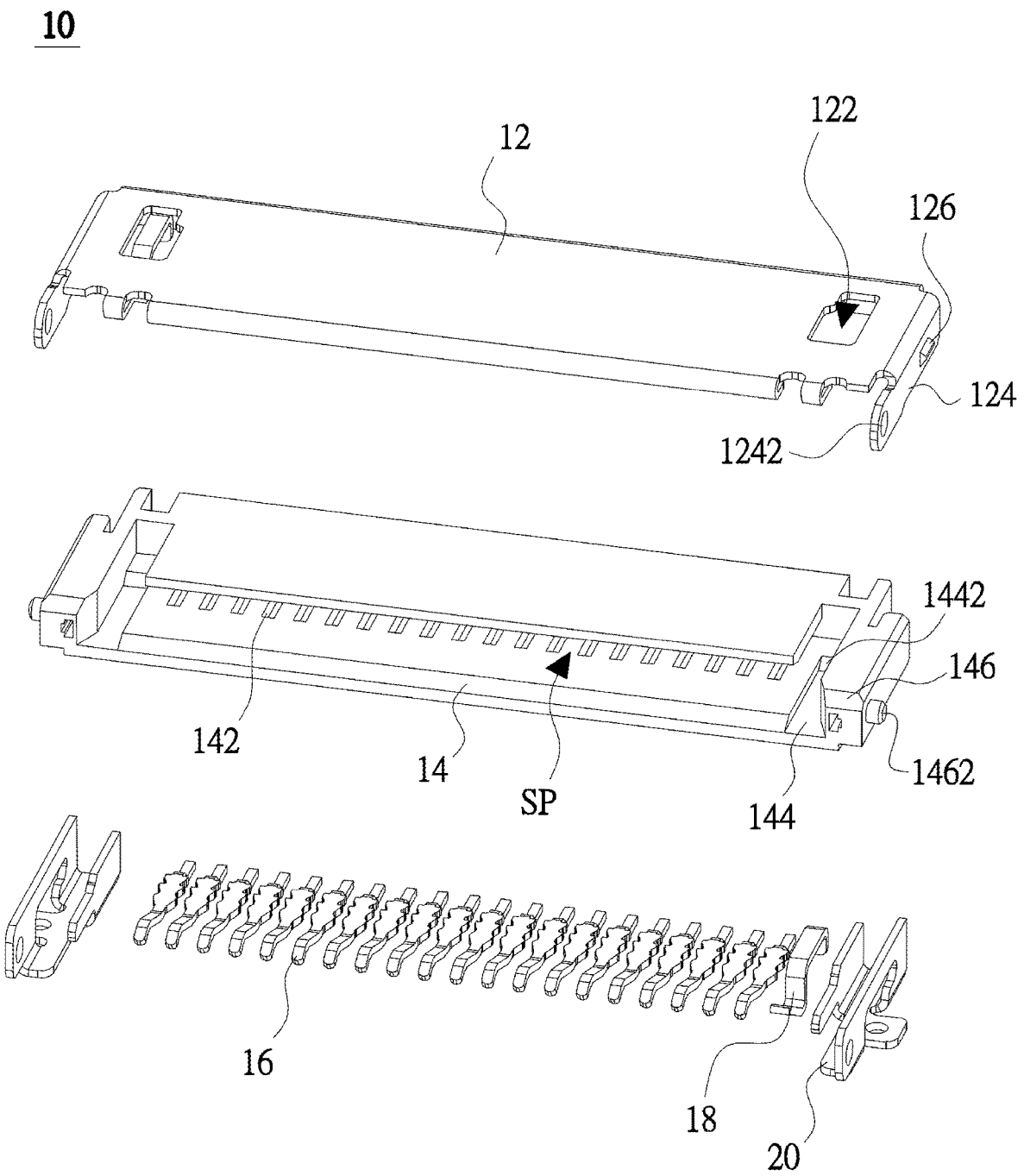
FIG. 2 is an exploded view diagram illustrating according to the connector of FIG. 1 of the invention.

Referring to FIG. 2 as well, it is an exploded view diagram of the connector in FIG. 1. The connector 10 includes an upper cover plate 12, a lower plate body 14, and an auxiliary member 20. Wherein the upper diagram of FIG.

2 discloses the structure of the upper cover plate 12, the middle diagram of FIG. 2 discloses the structure of the lower plate body 14 and the lower diagram of FIG. 2 discloses the structure of the terminals 16, the holding member 18, and the auxiliary member 20.

The upper cover plate 12 has a surface and an edge. Openings 122 are respectively formed on two sides of the surface adjacent to the edge. In addition, an extension arm 124 is formed on the edge of the upper cover plate 12. A fastening member 126 is formed on an outer side of the extension arm 124. A first connecting member 1242 is formed on the outer side of the extension arm 124. The fastening member 126 is a lug or a bump. Here, the first connecting member 1242 may be a through hole on the extension arm 124 or in other types.

The lower plate body 14 is connected to the upper cover plate 12. The lower plate body 14 provides an accommodation space SP to accommodate the cable 4. The lower plate body 14 comprises a terminal slot 142, an actuation slot 144, and a rotating base 146. The terminal slot 142 and the actuation slot 144 are formed in the accommodation space SP.

The terminal slot 142 is used for disposing terminals 16, and the actuation slot 144 is used for disposing a holding member 18. The structure of the holding member 18 can be referred to the structure disclosed in the cross-sectional diagram of FIG. 4. The holding member 18 may be an independent element or a member extending from the upper cover plate 12. Here, the latter is taken as an example.

Returning to FIG. 2, the rotating base 146 is formed on a side of the actuation slot 144 and provides a second connecting member 1462. Here, the second connecting member 1462 may be a protruding post on the rotating base 146 or in other types. Therefore, the rotating base 146 is coupled to the through hole of the extension arm 124 by the protruding post.

In another embodiment, the types of the first connecting member 1242 and the second connecting member 1462 may be used interchangeably. That is, the first connecting member 1242 may be a protruding post and the second connecting member 1462 may be a through hole. The holding member 18 is disposed at a position in the actuation slot 144 corresponding to the position of the opening 122. The rotation base 146 is disposed corresponding to the extension arm 124. In addition, the actuation slot 144 may form a stopper 1442. When the upper cover plate 12 and the lower plate body 14 are combined, the stopper 1442 is adjacent to the opening 122.

The auxiliary member 20 is disposed on the lower plate body 14 and is coupled to the rotating base 146. Here, the auxiliary base 20 engages with the rotating base 146 in a pin (or embedded) manner. Referring to the upper diagram of FIG. 3, which shows a detailed structure of the auxiliary member 20. The auxiliary member 20 further includes a joint part 204 and a buckle part 202. The joint part 204 is connected to the buckle part 202. The joint part 204 engages the rotation base 146, so that there is a gap between the buckle part 202 and the rotation base 146, which can accommodate the extension arm 124.

Figure 3:
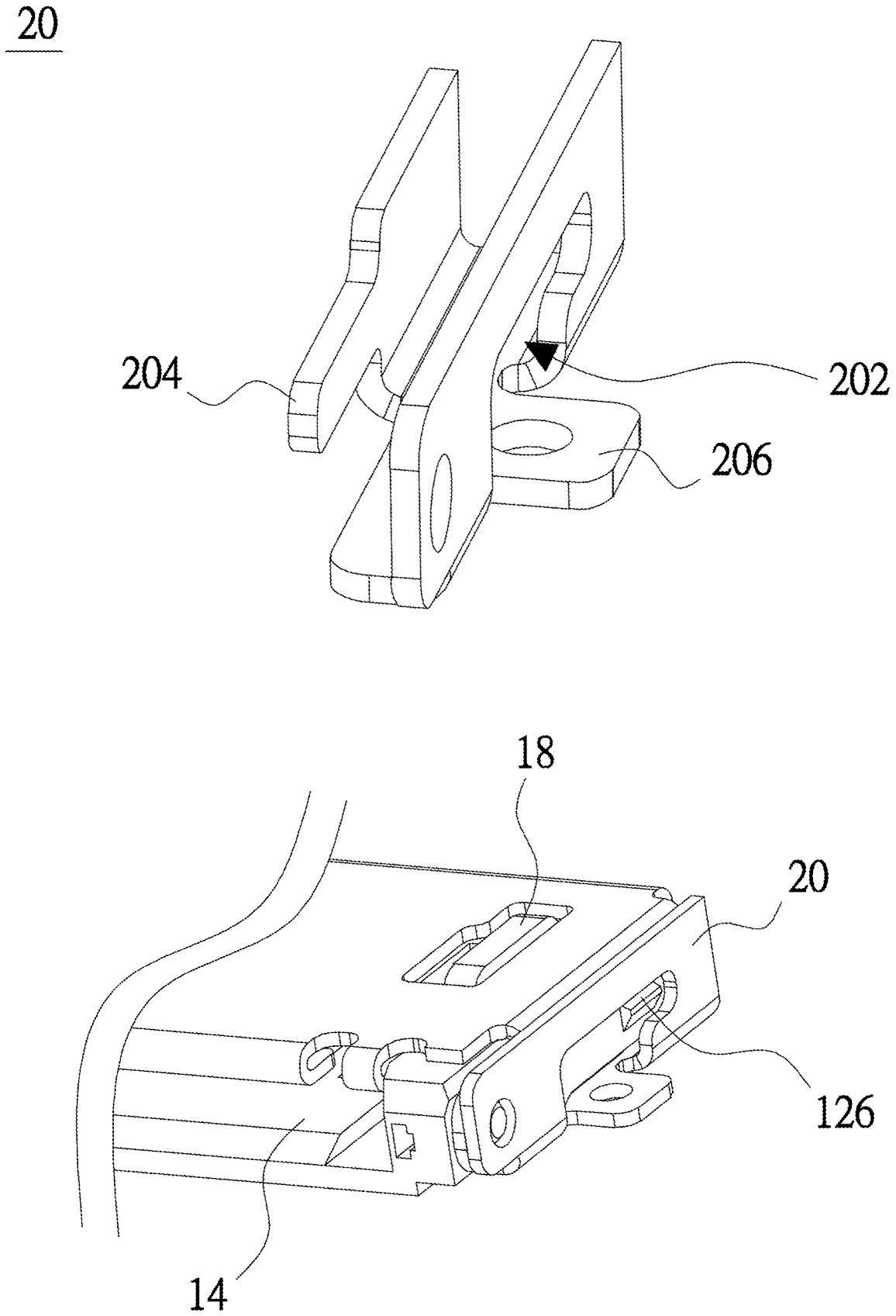
FIG. 3 illustrates the detailed structure of the auxiliary member of FIG. 1 according to the invention.

As shown in the lower diagram of FIG. 3, which is a schematic diagram illustrating the connection of the first connecting member and the second connecting member according to an embodiment of the invention. The upper cover plate 12 may be combined with the lower plate body 14 by engaging the first connecting member 1242 with the second connecting member 1462.

In another embodiment, the auxiliary member 20 further includes a fixing part 206 for locking the lower plate body 14 to the circuit board 2. In addition, when the buckle part 202 is an opening, the buckle part 202 (such as an opening) is buckled by the fastening member 126 (such as a lug or a bump), so that the angle between the upper cover plate 12 and the lower plate body 14 may be preserved at or near 0 degree.

Figure 4:
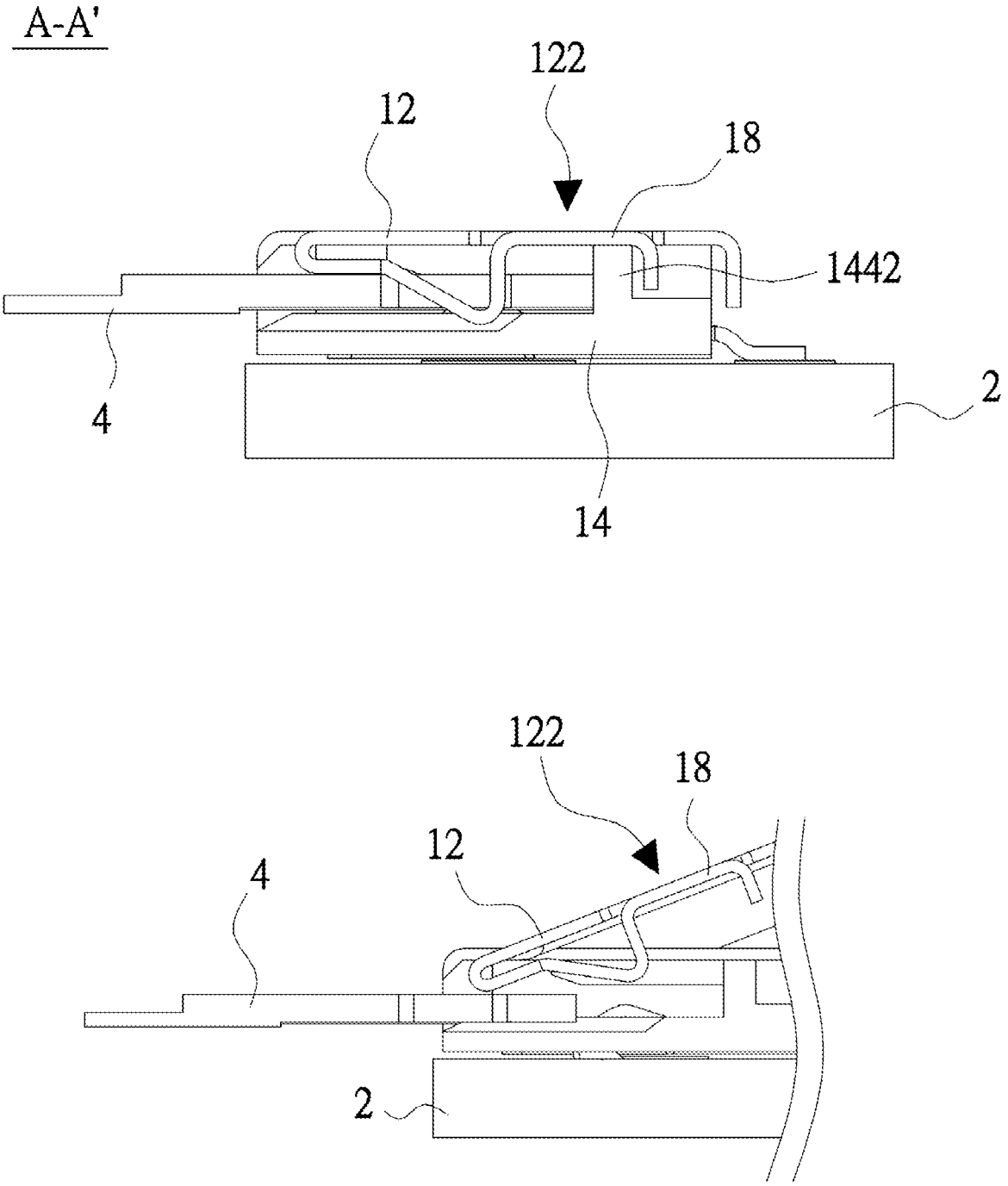
FIG. 4 is a schematic cross-sectional diagram taken along the line A-A' of the connector of FIG. 1 according to the invention.

Referring to FIG. 4, which is a schematic cross-sectional diagram taken along A-A' of the connector in FIG. 1. In the latch diagram in the upper diagram of FIG. 4, when the upper cover plate 12 is combined with the lower plate body 14, the rotating base 146 is fasten by the fastening member 126 (for example, rotate counterclockwise) so that the upper cover plate 12 is stably fasten with the lower plate body 14. Moreover, please also refer to the unlatched schematic diagram in the lower diagram of FIG. 4 together.

When the cable 4 is inserted into the accommodating space SP, the holding member 18 can hold the cable 4 in the accommodating space SP. The holding member 18 is squeezed by the cable 4 so that a part of the holding member 18 protrudes from the opening 122. When an external force (that is, a pulling force or wrenching) is applied to the upper cover plate 12, an angle is formed between the upper cover plate 12 and the lower plate body 14, and the holding member 18 is further deformed to release the cable 4.

The invention has been disclosed above with embodiments. However, the skilled in the art should understand that the embodiments are only used to describe the invention and should not be interpreted as limiting the scope of the invention. It should be noted that all changes and substitutions equivalent to the embodiments should be included in the scope of the invention. Therefore, the scope of protection of the invention shall be defined by the scope of the patent application claims.

What is claimed is:

1. A connector for connecting a cable to a circuit board, comprising:

an upper cover plate, comprising:

an opening disposed on a surface of the upper cover plate;

an extension arm formed on an edge of the upper cover plate;

a fastening member disposed on an outer side of the extension arm; and a first connecting member disposed on one terminal of the extension arm; and a lower plate body connecting the upper cover plate, wherein the lower plate comprises:

a terminal slot for disposing terminals;

an accommodation space for inserting the cable, wherein the accommodation space comprises:

an actuation slot; and a rotating base disposed on a side of the actuation slot for disposing the extension arm;

a holding member disposed in the actuation slot and corresponding to the opening; and a second connecting member disposed on a side of the rotating base; and an auxiliary member disposed on the lower plate body and coupled to the rotating base, wherein the upper cover plate is combined with the lower plate body by combining the first connecting member and the second connecting member, the fastening member acts on the rotating base and cooperates with the holding member for holding the cable in the accommodation space, and the cable is released by deforming the holding member when an external force is applied to the upper cover plate to form an angle between the upper cover plate and the lower plate body.

2. The connector of claim 1, wherein the opening is formed above the holding member, and when the holding member is deformed, the holding member penetrates the opening.

3. The connector of claim 1, wherein the auxiliary member comprises a joint part and a buckle part, the joint part connects to the buckle part, and the joint part engages the rotating base so that a gap is formed between the buckle part and the rotating base for accommodating the extension arm.

4. The connector of claim 3, wherein the auxiliary member further comprises a fixing part for locking the lower plate body onto the circuit board.

5. The connector of claim 3, wherein the fastening member is a lug or a bump and the buckling part is an aperture, and the lug or the bump is used for buckle the aperture to preserve the angle between the upper cover plate and the lower plate body at or substantially 0 degrees.

6. The connector of claim 1, wherein the first connecting member is a through hole, and the second connecting member is a protruding post for coupling to the through hole.

7. The connector of claim 6, wherein one end of the holding member connects to the upper cover plate, and the other end of the holding member is fastened to the actuation slot, so that the holding member is deformed by the external force which is applied to the upper cover plate.

8. The connector of claim 6, wherein the angle between the upper cover plate and the lower plate body rotates counterclockwise when the external force is applied to the upper cover plate.

9. The connector of claim 1, wherein a stopper is disposed in the actuation slot and adjacent to the opening when the upper cover plate is combined with the lower plate body.

10. The connector of claim 1, wherein the holding member is squeezed by the cable, so that a part of the holding member protrudes from and is exposed by the opening.

* * * * *